US011371328B1

(12) United States Patent
Zhou et al.

(10) Patent No.: US 11,371,328 B1
(45) Date of Patent: Jun. 28, 2022

(54) INTEGRATED METHOD FOR NITROGEN-ASSISTED CARBON DIOXIDE FRACTURING AND DEVELOPMENT OF SHALE OIL RESERVOIRS

(71) Applicant: Southwest Petroleum University, Chengdu (CN)

(72) Inventors: Xiang Zhou, Chengdu (CN); Qi Jiang, Chengdu (CN); Yongchao Wang, Chengdu (CN); Jie He, Chengdu (CN); Chunsheng Yu, Chengdu (CN); Siyuan Huang, Chengdu (CN); Yang Zhang, Chengdu (CN); Jiali Liu, Chengdu (CN); Fangjie Wu, Chengdu (CN); Guoqiang Tian, Chengdu (CN)

(73) Assignee: Southwest Petroleum University, Chengdu (CN)

( * ) Notice: Subject to any disclaimer, the term of this patent is extended or adjusted under 35 U.S.C. 154(b) by 0 days.

(21) Appl. No.: 17/547,092

(22) Filed: Dec. 9, 2021

(30) Foreign Application Priority Data

Dec. 14, 2020 (CN) ..... 202011470212.8

(51) Int. Cl.
*E21B 43/16* (2006.01)
*E21B 43/267* (2006.01)

(52) U.S. Cl.
CPC ..... *E21B 43/164* (2013.01); *E21B 43/166* (2013.01); *E21B 43/267* (2013.01)

(58) Field of Classification Search
CPC ..... E21B 43/164; E21B 43/166; E21B 43/267
See application file for complete search history.

(56) References Cited

U.S. PATENT DOCUMENTS

2014/0060831 A1* 3/2014 Miller ..... E21B 43/267 166/280.1
2014/0345880 A1 11/2014 Enis et al.
2018/0057732 A1* 3/2018 Babcock ..... C09K 8/58

FOREIGN PATENT DOCUMENTS

CN 102606117 A * 7/2012
CN 205117321 U 3/2016
(Continued)

OTHER PUBLICATIONS

Title of the book: Sinopec "Proceedings of Mineral Resources Compensation Exploration Projects and Protection Projects during the Tenth Five-Year Period" Publication date: Sep. 30, 2011 name of the author (in Capital Letters): Cai Xiyuan et al. title of the article:"Research and Application of CO2 Single Well Huff and Puff Enhanced Oil Recovery Technology".

*Primary Examiner* — Silvana C Runyan

(57) ABSTRACT

The invention discloses an integrated method for nitrogen-assisted carbon dioxide fracturing and development of shale oil reservoirs, comprising the following steps: fracture the target shale reservoir with nitrogen-assisted carbon dioxide; after fracturing, firstly inject carbon dioxide gas into the target shale oil reservoir, and then inject nitrogen gas to push the carbon dioxide gas into the further location of the oil reservoir; shut in the well in the target shale oil reservoir; after shut-in, open the well to implement depletion production; after the first cycle of production, the slug volume of the injected gas and the shut-in time are 1.5 times of those in the previous cycle in the subsequent production, and Steps 5 to 7 are repeated for each cycle. The present invention maximizes the recovery efficiency of shale oil reservoirs; in this way, carbon dioxide gas can be used most efficiently, making the development of shale reservoir more economical and efficient; the integrated fracturing and development design enables the field operation to be streamlined and (Continued)

standardized, and thus different departments to cooperate each other closer.

3 Claims, 7 Drawing Sheets

(56) References Cited

FOREIGN PATENT DOCUMENTS

| | | | | | |
|---|---|---|---|---|---|
| CN | 110005382 | A | | 7/2019 | |
| CN | 110424937 | A | | 11/2019 | |
| CN | 111764875 | A | | 10/2020 | |
| GB | 2142957 | A | * | 1/1985 | ..... C09K 8/594 |

* cited by examiner

INTEGRATED METHOD FOR NITROGEN-ASSISTED CARBON DIOXIDE FRACTURING AND DEVELOPMENT OF SHALE OIL RESERVOIRS

CROSS-REFERENCE TO RELATED APPLICATIONS

The application claims priority to Chinese patent application No. 202011470212.8, filed on Dec. 14, 2020, the entire contents of which are incorporated herein by reference.

TECHNICAL FIELD

The present invention pertains to the technical field of shale oil reservoir development, in particular to an integrated method for nitrogen-assisted carbon dioxide fracturing and development of shale oil reservoirs.

BACKGROUND

There are huge reserves of shale oil in China, with efficient development of crude oil providing an important guarantee to satisfy the energy demand of economic development in China. The key action for addressing energy crisis in China is to develop and utilize of such plentiful shale oil resources. However, the extremely low permeability and certain water-sensitivity effects of shale oil reservoirs make the conventional methods (water flooding) inapplicable for developing this type of crude oil (failure to water flooding into formation, damage caused by water flooding to formation). To facilitate shale oil development, the common way is gas injection process. Comparing different injection media (natural gas, nitrogen, carbon dioxide, etc.), carbon dioxide injection for shale oil development (huff and puff, displacement method, etc.) can achieve better production performances. In order to reduce the influence of shale reservoirs with extremely low permeability on the gas amount injected, fracturing is applied in shale oil formation to generate fractures of different directions and lengths in the formation, so that the injected gas can pass along the fractures to the deeper reservoir and contact the crude oil, so as to improve the recovery efficiency of shale oil.

In the fracturing process, carbon dioxide injection has many advantages over hydraulic fracturing: (1) the injected carbon dioxide gas will not produce water-sensitive effects, reducing the damage to the formation; (2) after fracturing, the injected carbon dioxide gas is directly injected into the formation to interact with the crude oil, serving the purpose of improving the recovery efficiency of shale oil; (3) the injected carbon dioxide gas reacts with the formation water in the oil reservoir to generate carbonated water which corrodes the nearby formation and improves the formation permeability to a certain extent, conducive to the flow of crude oil in the reservoir; (4) carbon dioxide gas is buried in the formation to reduce the carbon footprint.

However, there are certain limitations of carbon dioxide injection fracturing. On the one hand, it is difficult to capture a large amount of carbon dioxide gas due to the complex capture process; on the other hand, the transportation of liquid carbon dioxide by tanker truck is affected by distance and the cost is high due to regional limitations. Therefore, the reduction of the amount of carbon dioxide used will be an important factor to improve the economic efficiency while ensuring the efficiency of fracturing and development.

In the prior art, the Chinese invention patent document entitled "A supercritical carbon dioxide, nitrogen and hydraulic composite fracturing system" (Publication No.: CN205117321U) discloses a new fracturing system using supercritical carbon dioxide, nitrogen and water as a composite medium, consisting of $N_2$ tank and $CO_2$ tank. The outlet of the $CO_2$ tank is sequentially connected a heater, a booster pump and a stirring viscosity regulator by a pipe. The outlet of the $N_2$ tank is connected to the inlet of the heater by a pipe. A control valve and an air separator are installed on the pipe between the $N_2$ tank inlet and the $CO_2$ tank inlet sequentially. The other inlet of the booster pump is connected with a water-based fracturing fluid tank, a liquid separator, a shale gas separator, an air compressor, and a cooler in turn through a pipe. The outlet of the cooler is connected with the inlet of the air separator, and the other inlet of the liquid separator is connected with a solid separator and a depressurization pump through a pipe. The patent elaborates the pressure system device with compact structure and simple process flow; however, it does not address how to implement fracturing operation in shale reservoirs and the principle, characteristics, and advantages of nitrogen-assisted carbon dioxide fracturing.

The Chinese invention patent document entitled "A method of developing tight oil by nitrogen-assisted carbon dioxide huff and puff (Publication No.: CN108397171A) discloses a method for developing tight oil by nitrogen-assisted carbon dioxide huff and puff: after the first cycle of carbon dioxide huff and puff, nitrogen and carbon dioxide are successively injected into the tight oil reservoir in a certain proportion in the second cycle, and shut in the well after injection. In well shut-in, the nitrogen diffuses to the deeper formations with the carbon dioxide. Due to the low solubility of nitrogen in crude oil, nitrogen can maintain the formation pressure, thereby increasing the elastic energy of the formation. The synergistic effect of nitrogen and carbon dioxide allows the oil well to maintain high oil production after single huff-and-puff. It can effectively maintain formation pressure and improve tight oil recovery after multiple cycles of huff and puff. However, due to high carbon dioxide consumption, mixed nitrogen inhibits the diffusion efficiency of carbon dioxide into the reservoir to some extent, making it difficult to maximize tight oil recovery.

SUMMARY

The present invention aims to overcome the disadvantages in the prior art, and provides integrated method for nitrogen-assisted carbon dioxide fracturing and development of shale oil reservoirs.

The technical solution provided by the present invention to solve the above technical problem is an integrated method for nitrogen-assisted carbon dioxide fracturing and development of shale oil reservoirs, comprising:

Step 1: Fracture the target shale reservoir with nitrogen-assisted carbon dioxide;

Step 2: After fracturing, firstly inject carbon dioxide gas into the target shale oil reservoir, and then inject nitrogen gas to push the carbon dioxide gas into the further location of the targeted oil reservoir;

Step 3: Shut in the well, to ensure the injected carbon dioxide gas can be fully recombined into shale oil, expand the volume of shale oil, reduce the viscosity, and extract the light components of shale oil;

Step 4: After shut-in, open the well to implement depletion production, and terminate the first cycle of production when the reservoir pressure is depleted to ½ of the original reservoir pressure;

Step 5: After the first cycle of production, inject carbon dioxide gas into the target shale oil reservoir, and then inject nitrogen gas to push the carbon dioxide gas into the further location of the oil reservoir while increasing the reservoir pressure to be close to the original reservoir pressure, where the slug volume of carbon dioxide gas and nitrogen gas is 1.5 times of that in Step 3;

Step 6: Shut in the well in the target shale reservoir for 1.5 times of that in Step 3;

Step 7: After shut-in, open the well to implement depletion production, and terminate the second cycle of production when the reservoir pressure is depleted to ½ of the original reservoir pressure;

Step 8: In the subsequent production process, the slug volume of the injected gas and the shut-in time are 1.5 times of the previous cycle, and Steps 5 to 7 are repeated for each cycle.

In the further technical solution, the specific fracturing operation in Step 1 is:

Inject 0.1 PV high-pressure carbon dioxide gas to form slugs in the early stage, and then inject 0.1 PV high-pressure nitrogen gas;

Increase the injected gas pressure to rise the pressure in the wellbore to be greater than the shale oil fracture pressure, fracturing the target shale oil reservoir and injecting proppant into the fractures so that the fractures will not be closed, which is conducive to subsequent gas injection.

In the further technical solution, the slug volumes of carbon dioxide gas and nitrogen gas in Step 2 are both 0.1-0.2 PV.

In the further technical solution, the pressures of carbon dioxide gas and nitrogen gas in Step 2 are the reservoir pressure of the target shale reservoir.

In the further technical solution, the shut-in time in Step 3 is 30-45 days.

The present invention has the following beneficial effects: the carbon dioxide gas injected into the oil reservoir in the present invention can mix with the shale oil in the oil reservoir under high pressure, extract the light components in the crude oil, expand the volume of the crude oil, and reduce the viscosity of crude oil; the nitrogen gas injected into the reservoir pushes the carbon dioxide gas to the further location of the reservoir to fully contact with the crude oil, improving the oil recovery efficiency, on the other hand, maintains the reservoir pressure, so as to maximize the recovery efficiency of shale oil reservoirs; in this way, carbon dioxide gas can be used most efficiently, making the development of shale reservoir more economical and efficient; the integrated fracturing and development design enables the field operation to be streamlined and standardized and the different departments to cooperate each other closer.

DETAILED DESCRIPTION OF THE EMBODIMENTS

The technical solutions of the present invention will be described expressly and integrally in conjunction with the appended figures. It is clear that the described embodiments are some but not all of the embodiments of the present invention. On the basis of the embodiments of the present invention, all other embodiments obtained by those of ordinary skill in the art without creative effort fall within the protection scope of the present invention.

Figure 1:
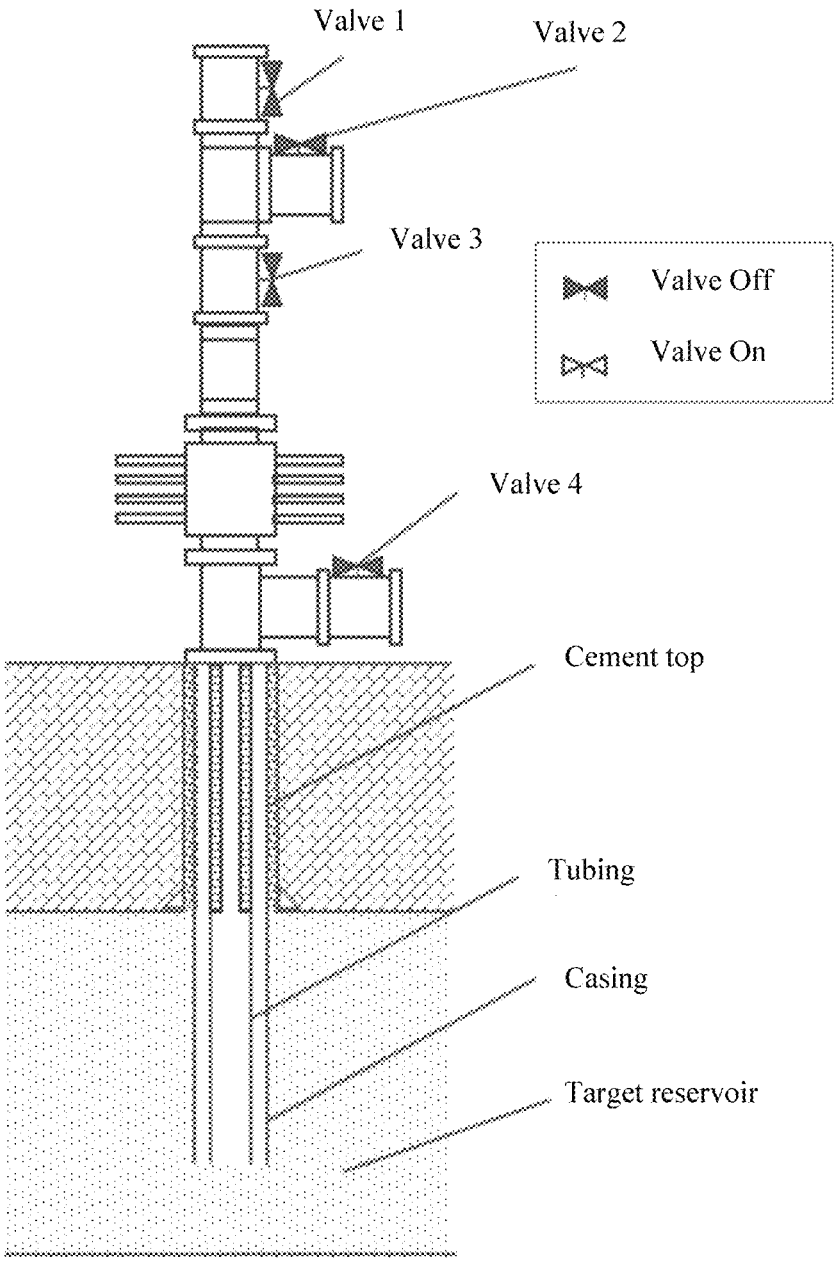
FIG. 1 is a diagram of wellbore structure after well completion in the shale oil reservoir.

At the end of drilling operation (after well completion), the perforated well interval is located deep in the shale oil reservoir, as shown in FIG. 1. In the operation of carbon dioxide gas injection to enhance oil recovery, the permeability of the shale oil reservoir is extremely low, resulting in the inability to inject carbon dioxide gas efficiently, thereby preventing the development effect from reaching the expected level.

Therefore, the present invention is dedicated to maximizing the use of nitrogen and carbon dioxide by utilizing nitrogen-assisted carbon dioxide for the most important tasks: (1) Fracture the shale reservoir with nitrogen-assisted carbon dioxide and (2) develop the shale oil by nitrogen-assisted carbon dioxide in the fractured reservoirs.

Figure 2:
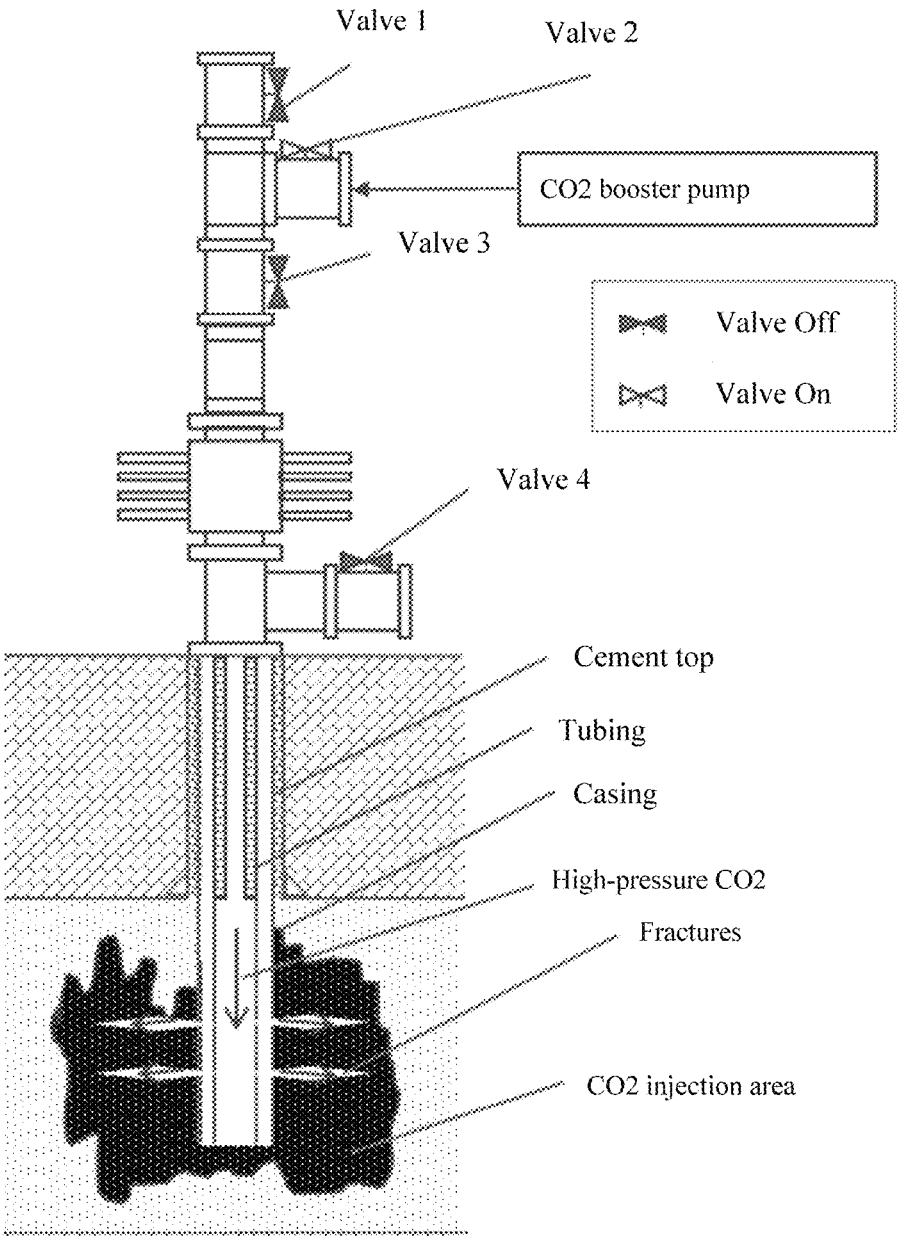
FIG. 2 is a schematic diagram of wellbore structure for fracturing shale oil reservoir by carbon dioxide injection.
Figure 3:
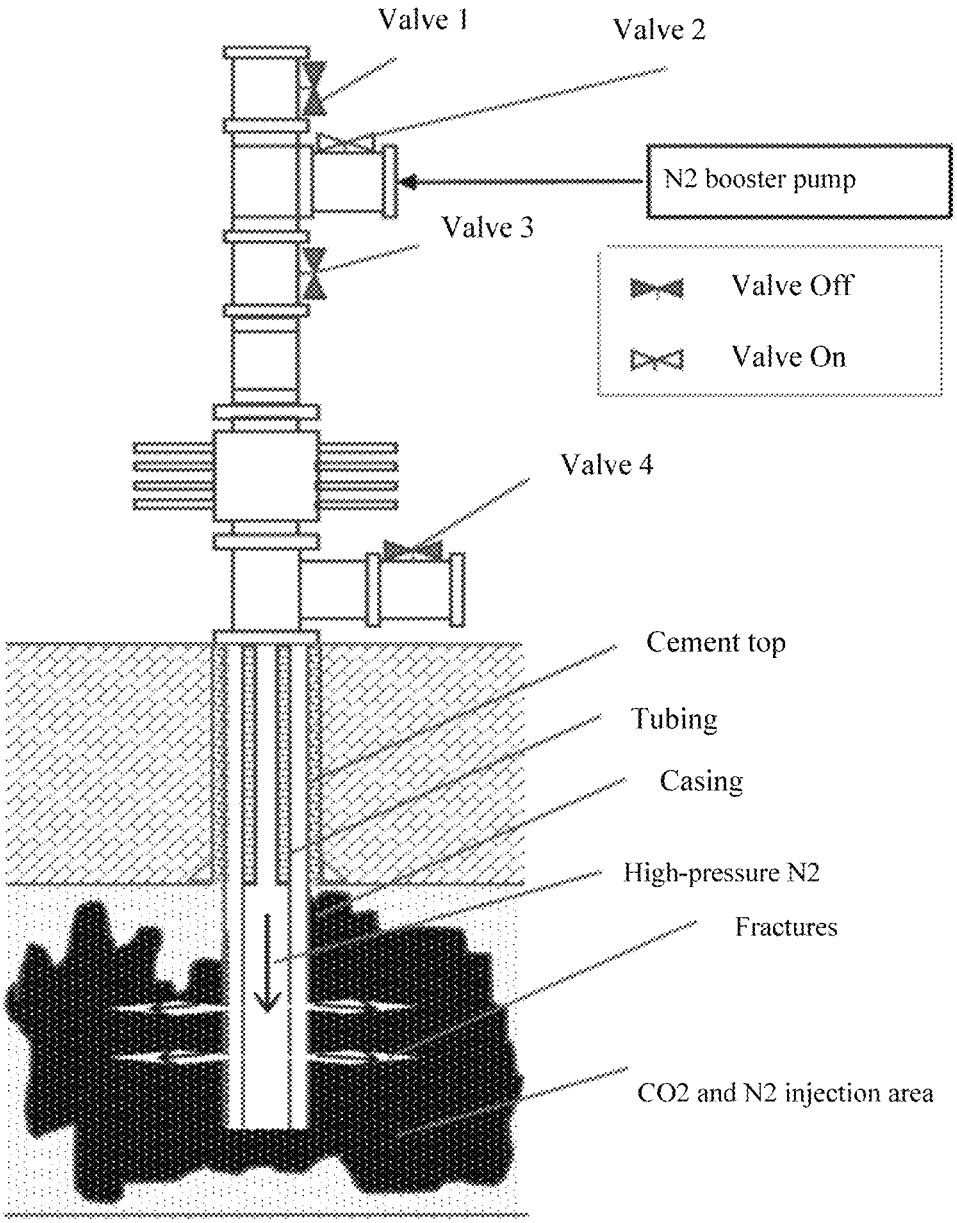
FIG. 3 is a schematic diagram of wellbore structure with nitrogen injection to maintain pressure after carbon dioxide injection for fracturing.
Figure 4:
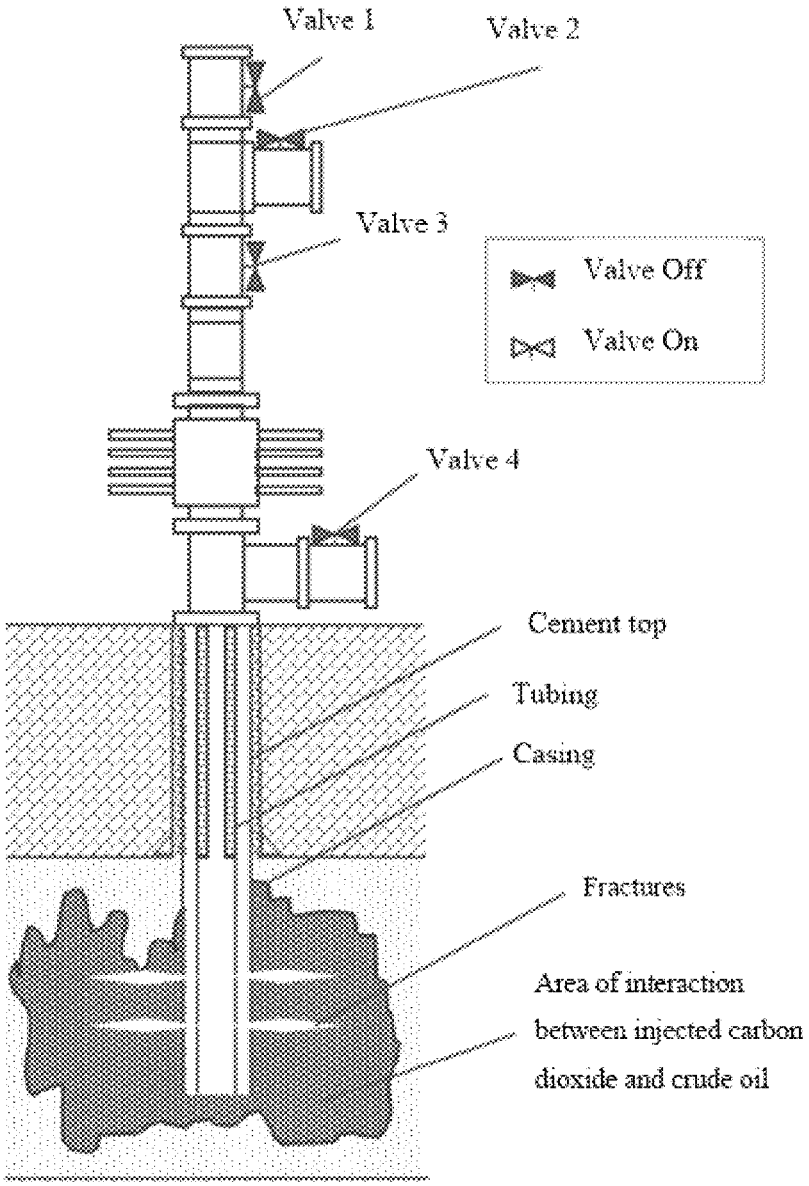
FIG. 4 is a schematic diagram of wellbore structure in shut-in stage after gas injection and fracturing.
Figure 5:
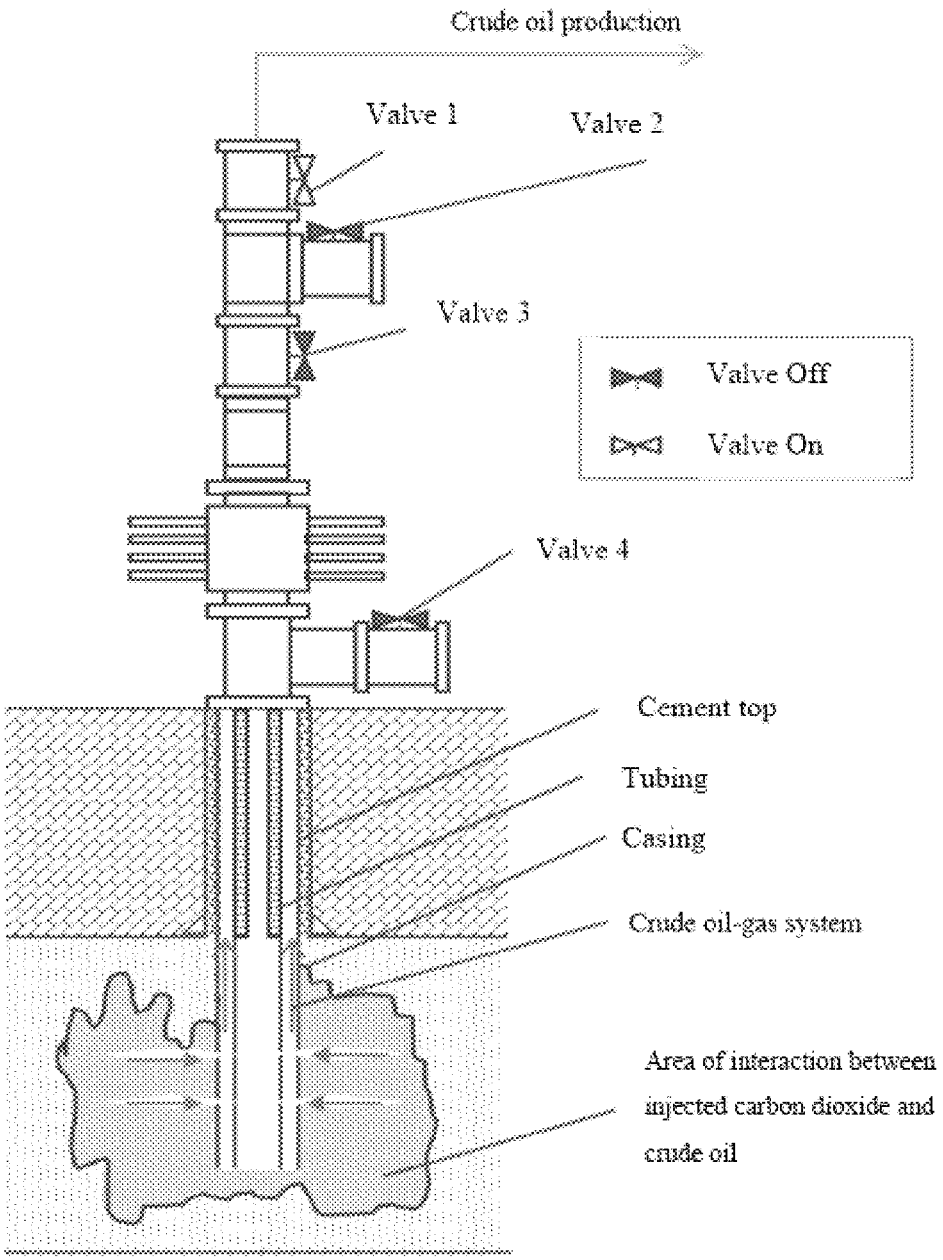
FIG. 5 is a schematic diagram of wellbore structure in production stage after well opening.

The integrated method for nitrogen-assisted carbon dioxide fracturing and development of shale oil reservoirs provided by the present invention can not only make full use of injected gases (nitrogen and carbon dioxide), but also organically combine fracturing with enhanced oil recovery, and the specific steps are as follows:

Step 100: Fracture the shale oil reservoir with high-pressure carbon dioxide gas, inject 0.1 PV high-pressure carbon dioxide to form slug in the early stage, and then inject 0.1 PV high-pressure nitrogen gas (as shown in FIG. 2);

Step 200: Increase the injected gas pressure to rise the pressure in the wellbore to be greater than the shale oil fracture pressure, fracturing the shale oil reservoir and injecting the designed proppant into the fractures so that the fractures will not be closed, which is conducive to subsequent gas injection; the injected carbon dioxide gas is injected into the oil reservoir through the fracture, on the one hand, to make fractures in the oil reservoir, and on the other hand, to flow into the deeper formation along the fractures, further contacting with shale oil fully and improving the recovery efficiency of shale oil;

Step 300: After fracturing, inject 0.1-0.2 PV carbon dioxide gas under the reservoir pressure to form slugs in the oil reservoir, to contact and interact with the crude oil in the further location of the shale oil reservoir, and then inject 0.1-0.2 PV nitrogen gas under the same pressure to form slugs for maintaining formation pressure and pushing the injected carbon dioxide gas to the further location of the reservoir, as shown in FIG. 3;

Step 400: Shut in the oil well for 30-45 days to fully mix shale oil with injected carbon dioxide gas, expand the volume of shale oil, reduce the viscosity, extract the light components of shale oil, improve the mobility of the crude oil, and thus improves the recovery efficiency of the crude oil, as shown in FIG. 4;

Step 500: After the shut-in process, open the well and implement depletion production under higher pressure because the injected gas (carbon dioxide, nitrogen) maintains the formation pressure, then control the pressure depletion rate of the production well, and terminate the first cycle of production when the reservoir pressure is depleted to ½ of the original reservoir pressure, as shown in FIG. 5;

Step 600: Inject 0.15-0.3 PV carbon dioxide gas into the oil well to form slugs, and subsequently inject 0.15-0.3 PV nitrogen gas under the same pressure to push the carbon dioxide gas into the further location of the reservoir while increasing the reservoir pressure to be close to original reservoir pressure;

Step 700: Shut in the oil well for 45-60 days in the oil reservoir;

Step 800: After the shut-in process, open the well to implement depletion production, control the pressure depletion rate of the production well, and terminate the second cycle of production when the reservoir pressure depletes to ½ of the original reservoir pressure;

Step 900: In the subsequent production process, the slug volume of the injected gas and the shut-in time are about 1.5 times of the previous cycle, and Steps 600 to 800 are repeated for each cycle.

In the present invention, nitrogen is used to replace carbon dioxide gas in some operations for such reasons as (1) the nitrogen gas content in the air is much greater than that of carbon dioxide gas, making the preparation process of nitrogen gas is simpler than that of carbon dioxide gas, (2) the liquefaction pressure of nitrogen is lower than that of carbon dioxide, resulting in larger volume and higher safety in the transportation, and (3) the nitrogen production requires a lower investment than carbon dioxide production, achieving more cost-effective production.

EXPERIMENTAL EXAMPLES

Huff and puff experiments of different gas media (pure carbon dioxide, carbon dioxide and nitrogen) were carried out with long shale cores after fracturing. In Experiment 1, the injected gas was pure carbon dioxide. In Experiment 2, the first injected gas was carbon dioxide, and then nitrogen was injected for maintaining the pressure.

Figure 6:
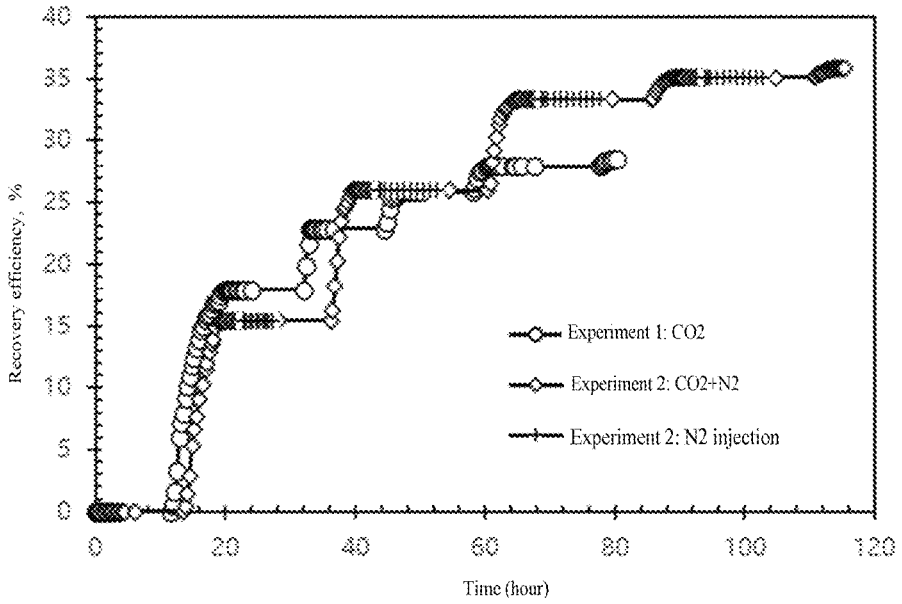
FIG. 6 is a comparison diagram of recovery efficiencies in huff and puff experiments of long fractured shale cores with different gas media.
Figure 7:
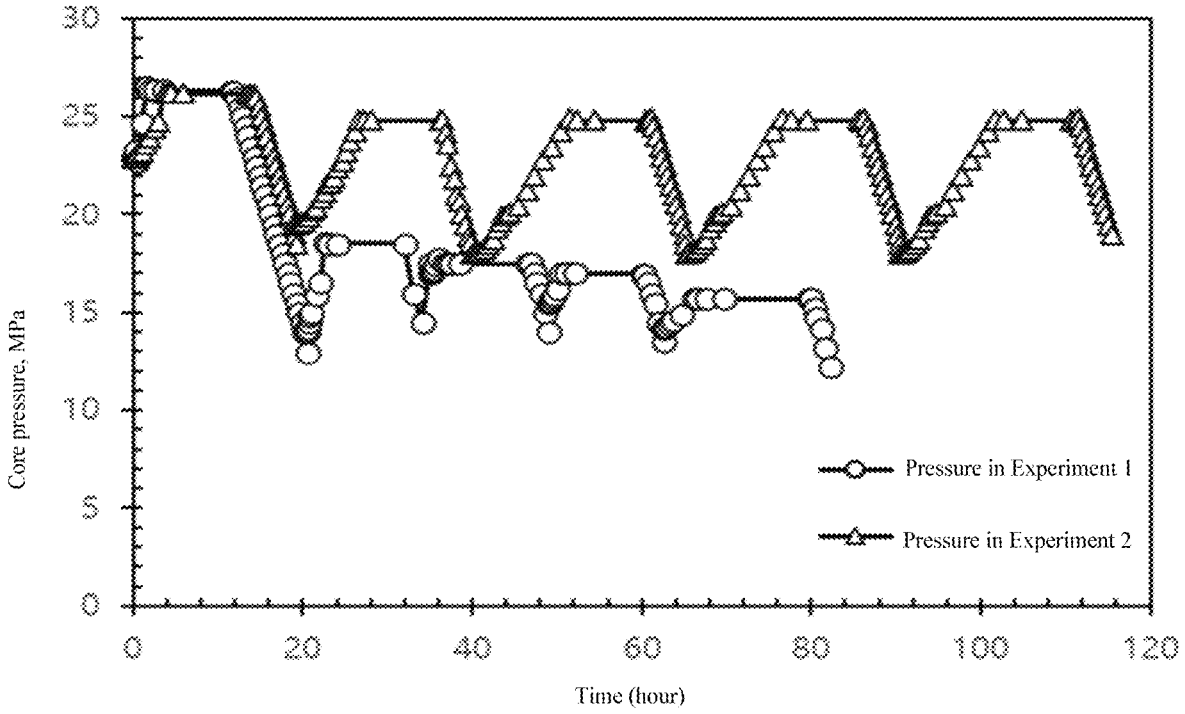
FIG. 7 is a comparison diagram of pressures in huff and puff experiments of long fractured shale cores with different gas media.

During the experiments, the amount of carbon dioxide injected was 0.1 time of the pore volume, the shut-in time was 10 hours, and the pressure depletion rate was 30 kPa/min in each huff-and-puff cycle. After five huff-and-puff cycles, as shown in FIG. 6, the recovery efficiency reached 28.51% in Experiment 1, and reached 35.83% in Experiment 2 under the pressure maintained by nitrogen. As shown in FIG. 7, in Experiment 1, the same volume of carbon dioxide was injected in each cycle, resulting in a gradual decrease in the core pressure, which could not be maintained and the replacement energy was reduced. In Experiment 2, due to the subsequent nitrogen injection, the core pressure was maintained, improving the displacement energy in the experiment and leading to higher oil recovery factor.

The above are not intended to limit the present invention in any form. Although the present invention has been disclosed as above with embodiments, it is not intended to limit the present invention. Those skilled in the art, within the scope of the technical solution of the present invention, can use the disclosed technical content to make a few changes or modify the equivalent embodiment with equivalent changes. Within the scope of the technical solution of the present invention, any simple modification, equivalent change and modification made to the above embodiments according to the technical essence of the present invention are still regarded as a part of the technical solution of the present invention.

What is claimed is:

1. An integrated method for nitrogen-assisted carbon dioxide fracturing and development of shale oil reservoirs, comprising:

Step 1: Fracture a target shale oil reservoir with nitrogen-assisted carbon dioxide;

Step 2: After fracturing, firstly inject carbon dioxide gas into the target shale oil reservoir, and then inject nitrogen gas to push the carbon dioxide gas into a further location of oil reservoir;

Step 3: Shut in a well, to ensure that the injected carbon dioxide gas can be recombined into shale oil, expand a volume of the shale oil, reduce a viscosity of the shale oil, and extract light components of the shale oil;

Step 4: After shut-in, open the well to implement depletion production, and terminate a first cycle of production when a reservoir pressure is depleted to ½ of an original reservoir pressure;

Step 5: After the first cycle of production, inject the carbon dioxide gas into the target shale oil reservoir, and then inject the nitrogen gas to push the carbon dioxide gas into the further location of the oil reservoir while increasing the reservoir pressure to be close to the original reservoir pressure, wherein a slug volume of carbon dioxide gas and nitrogen gas is 1.5 times of that in Step 3;

Step 6: Shut in the well in the target shale reservoir for 1.5 times of that in Step 3;

Step 7: After shut-in, open the well to implement the depletion production, and terminate a second cycle of production when the reservoir pressure is depleted to ½ of the original reservoir pressure; and Step 8: In a subsequent production process, the slug volume of the injected carbon dioxide gas, the injected nitrogen gas, and a shut-in time are 1.5 times of those in the previous cycle, and Steps 5 to 7 are repeated for each cycle, wherein the fracturing of the target shale oil reservoir with nitrogen-assisted carbon dioxide operation in Step 1 comprises:

injecting 0.1 PV (pressure volume) of the carbon dioxide gas to form slugs in an early stage, and then injecting 0.1 PV (pressure volume) of the nitrogen gas;

increasing the pressure of the injected carbon dioxide and the injected nitrogen to increase pressure in a wellbore to be greater than pressure of a shale oil reservoir, fracturing the target shale oil reservoir; and injecting proppant into fractures so that to ensure that the fractures will not be closed, which is conducive to subsequent gas injection.

2. The integrated method for nitrogen-assisted carbon dioxide fracturing and development of shale oil reservoirs according to claim 1, wherein slug volumes of carbon dioxide gas and nitrogen gas in Step 2 are both 0.1-0.2PV (pressure volume).

3. The integrated method for nitrogen-assisted carbon dioxide fracturing and development of shale oil reservoirs according to claim 2, wherein pressures formed due to injection of the carbon dioxide gas into the target shale oil reservoir, and injection of the nitrogen gas to push the carbon dioxide gas into the further location of oil reservoir in Step 2 are reservoir pressures of the target shale oil reservoir.

* * * * *